US006231059B1

(12) United States Patent
Cheldin

(10) Patent No.: US 6,231,059 B1
(45) Date of Patent: May 15, 2001

(54) GOLF BAG PULL CART HAVING INTEGRAL EXTENDABLE ROLLERS AND HANDLE

(76) Inventor: Erwin Cheldin, 23251 Mulholland Dr., Woodland Hills, CA (US) 91364-2732

( * ) Notice: Subject to any disclaimer, the term of this patent is extended or adjusted under 35 U.S.C. 154(b) by 0 days.

(21) Appl. No.: 09/442,577

(22) Filed: Nov. 18, 1999

Related U.S. Application Data

(63) Continuation-in-part of application No. 09/315,658, filed on May 20, 1999.

(51) Int. Cl.[7] ..... B62B 1/00
(52) U.S. Cl. ..... 280/47.24
(58) Field of Search ..... 280/47.28, 47.17, 280/47.18, 47.24, 47.26, 47.27, 6 D; 301/128

(56) References Cited

U.S. PATENT DOCUMENTS

| | | | | |
|---|---|---|---|---|
| 2,556,814 | * | 6/1951 | Love | 280/53 |
| 2,868,559 | * | 1/1959 | Vincelette | 280/47.33 |
| 2,902,287 | | 9/1959 | Elias . | |
| 2,962,294 | | 11/1960 | Elias . | |
| 3,425,708 | | 2/1969 | Sato . | |
| 3,550,999 | | 12/1970 | Bogan . | |
| 3,953,045 | | 4/1976 | Feret, Jr. . | |
| 4,053,169 | | 10/1977 | Taylor . | |
| 4,245,684 | | 1/1981 | Street et al. . | |
| 4,382,612 | | 5/1983 | Larkin . | |
| 4,522,299 | | 6/1985 | Clark et al. . | |
| 4,735,425 | | 4/1988 | Hoff . | |
| 4,822,071 | | 4/1989 | Widegren . | |
| 4,832,362 | | 5/1989 | Chen . | |
| 4,911,465 | | 3/1990 | Hauer . | |
| 5,071,147 | * | 12/1991 | Stansbury | 280/47.19 |
| 5,112,068 | | 5/1992 | Liao et al. . | |
| 5,267,750 | | 12/1993 | Thompson . | |
| 5,435,581 | * | 7/1995 | Rosenfield | 280/30 |
| 5,454,576 | * | 10/1995 | Pitkanen | 280/42 |
| 5,470,095 | | 11/1995 | Bridges . | |
| 6,050,592 | * | 4/2000 | Kim | 280/652 |

* cited by examiner

*Primary Examiner*—Brian L. Johnson
*Assistant Examiner*—Tony Winner
(74) *Attorney, Agent, or Firm*—Kelly, Bauersfeld, Lowry & Kelley, LLP

(57) ABSTRACT

A golf bag pull cart includes a support frame having a base and a spine extending upwardly from the base. An arm having a handle at one end is pivotally attached to the spine so as to position the handle adjacent to the spine in a folded carrying position and away from the spine in an extended position. A pair of wheels are rotatably affixed to the frame adjacent to the base and are extendable away from and retractable towards the base. The base includes wheel recesses which at least partially accept the retracted wheels. In one embodiment, the support frame is integrally formed with a golf bag. In another embodiment, the golf bag rests on the base and spine of the support frame with straps securing it in place.

13 Claims, 5 Drawing Sheets

GOLF BAG PULL CART HAVING INTEGRAL EXTENDABLE ROLLERS AND HANDLE

RELATED APPLICATION

This application is a continuation-in-part of U.S. patent application Ser. No. 09/315,658, filed May 20, 1999.

BACKGROUND OF THE INVENTION

The present invention relates to golf bags and carts. More specifically, the present invention relates to a golf bag pull cart having laterally extending wheels and an integral extendable arm which provides a handle for the pull cart.

A golf bag is considered standard equipment for any golfer. A golf bag typically includes an elongated, open-top container which accommodates the length of golf clubs, and also various pockets for golf balls, tees, towels, shoes and other golf related items. A golfer can either carry the golf bag over his or her shoulders using straps, tote the golf bag on a riding cart, or place the golf bag on a separate device known as a pull cart.

Many golfers prefer walking to avoid the costs of a riding cart or to obtain a degree of exercise while golfing. Although a golf bag is convenient for its ease of carrying from one location to another, it becomes quite heavy and cumbersome when carried over the length of a golf course. The golf bag can also cause soreness to the golfer's back and shoulder area. As a result, pull carts are frequently used on the golf course in order to obtain the benefits of walking without the need to carry the bag. However, the use of pull carts has its disadvantages.

The golf pull cart is generally constructed of a rigid metal frame with golf bag securing straps, outspread wheels and an upwardly extended handle. Although the cart performs adequately on the golf course, it is often heavy and bulky. Loading the cart and bag when strapped together in a trunk can be very difficult, and both may not fit in the trunks of smaller cars. Oftentimes, the golf bag must be separated from the cart and the cart transported and stored separately. This requires the re-strapping of the bag to the cart when reaching the golf course. Due to the awkwardness of handling typical golf bag pull carts, golfers often leave their own pull carts at home and rent a cart at the golf course when traveling.

Attempts have been made to devise foldable golf carts which aid in transportation; however, these foldable pull carts are also heavy and oftentimes bulky as well. Another problem associated with prior foldable pull carts is that they require the loosening and re-tightening of parts in order to unfold the cart for use. Other attempts have been made to combine the pull cart and golf bag into one unit. However, these devices are usually heavy and bulky as they are comprised of the essential components of a pull cart attached to a golf bag. Many of these devices are also complex in their construction and difficult to manipulate and operate.

Therefore, what is needed is a golf bag which can be easily pulled behind a golfer on a golf course and yet is relatively light weight, simple in construction and easy to operate, store and transport. The present invention fulfills these needs, and provides other related advantages.

SUMMARY OF THE INVENTION

The present invention resides in a golf bag pull cart comprising, generally, a support frame having a base and a spine extending upwardly from the base, and an elongated arm which is pivotally attached to the spine so as to position a handle adjacent to the spine in a folded carrying position, and away from the spine in an extended position. A pair of wheels are affixed to the frame adjacent to the base and rotated about a common axis. The wheels are extendable away from and retractable towards the base along the axis.

A locking clasp is associated with the arm and connected to the spine so as to permit the arm to pivot. The locking clasp includes first and second discs which each have uniform radial interfitting teeth that allow the discs to be rotated relative to one another and locked in place. A tightening screw is inserted through aligned apertures of the first and second discs for securely fastening the locking clasp together.

In one illustrated form of the invention, the spine and base of the support frame are integrally formed into a golf bag. The base is formed at a bottom of the golf bag and the spine extends upwardly from the base along a side thereof. The golf bag itself includes recesses formed at the base for receiving the wheels when retracted. One or more shoulder straps are connected from an upper to a lower end of the golf bag. A support stand may also be connected to the golf bag.

In another illustrated form of the invention, the golf bag is exteriorly supported by the base and the spine and fastened thereto by retaining straps.

Other features and advantages of the present invention will become apparent from the following more detailed description, taken in conjunction with the accompanying drawings which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

Figure 1:
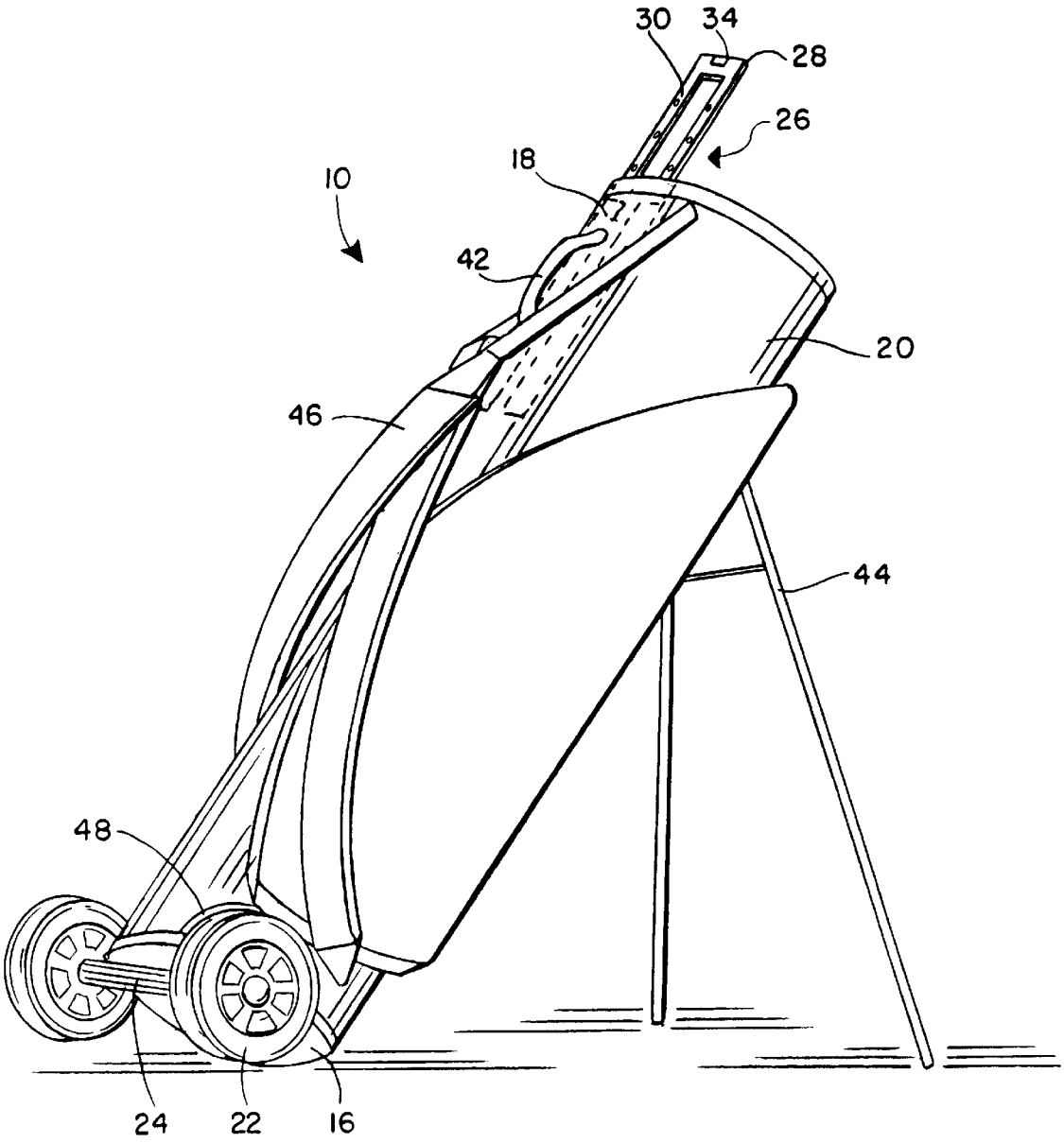
FIG. 1 is a rear and side perspective view of a golf bag pull cart embodying the present invention.
Figure 2:
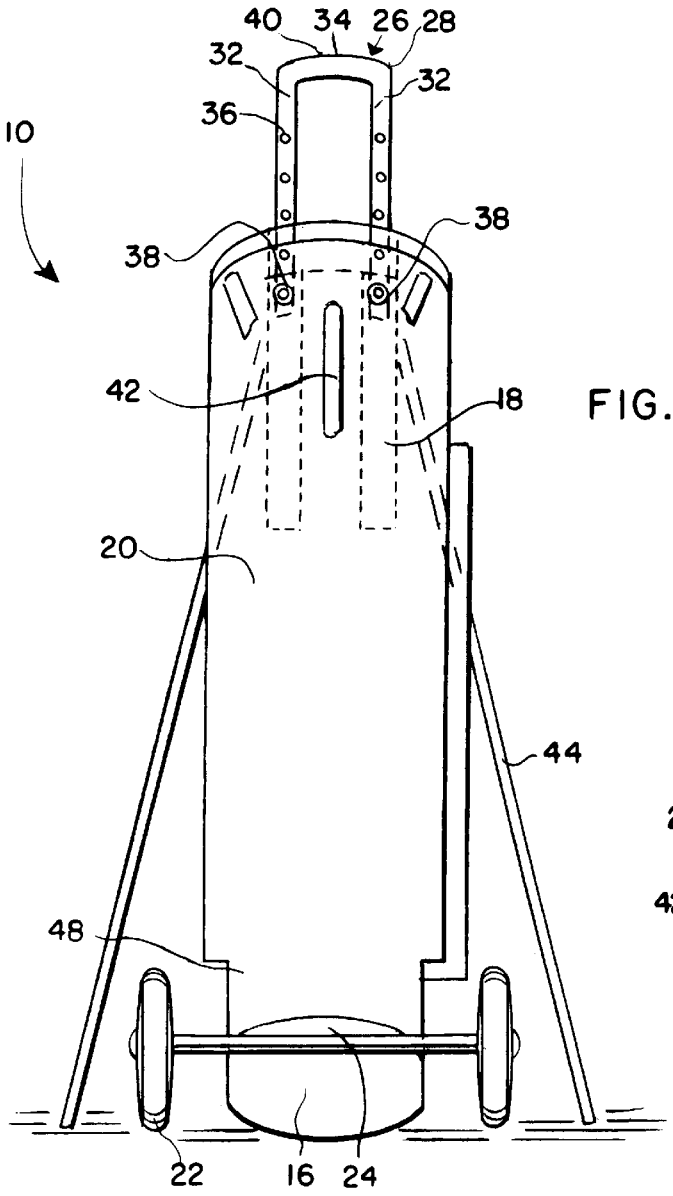
FIG. 2 is a partially fragmented rear elevational view of the golf bag pull cart of FIG. 1, illustrating the extension of an elongated arm from a support frame integrated into the golf bag and extension of the wheels from a base.
Figure 3:
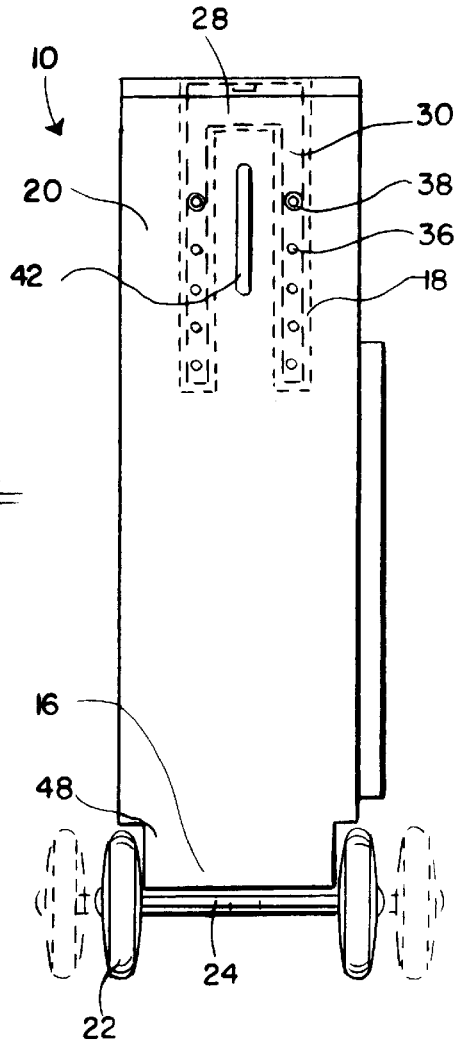
FIG. 3 is a partially fragmented rear elevational view of the golf bag pull cart of FIGS. 1 and 2, illustrating the retraction of the elongated arm into the golf bag and retraction of the wheels into recesses formed in the base.
Figure 4:
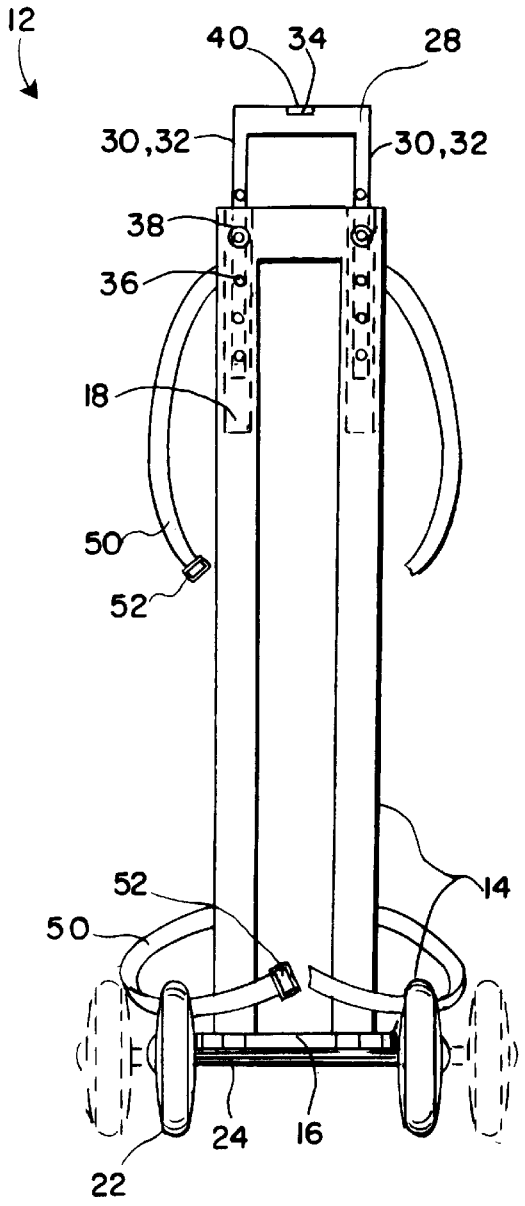
FIG. 4 is a front elevational view of a second embodiment of the golf bag pull cart of the present invention, illustrating the elongated arm partially extended from a spine of the support frame.
Figure 5:
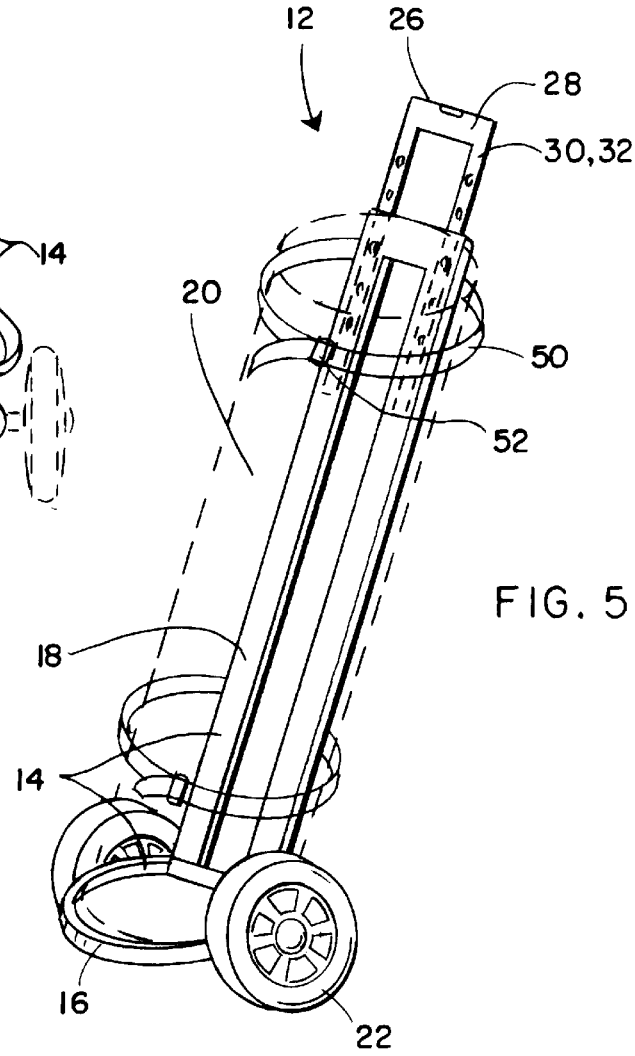
FIG. 5 is a side and front perspective view of the golf bag pull cart of FIG. 4, illustrating, in phantom, a golf bag securely fastened to the support frame.
Figure 6:
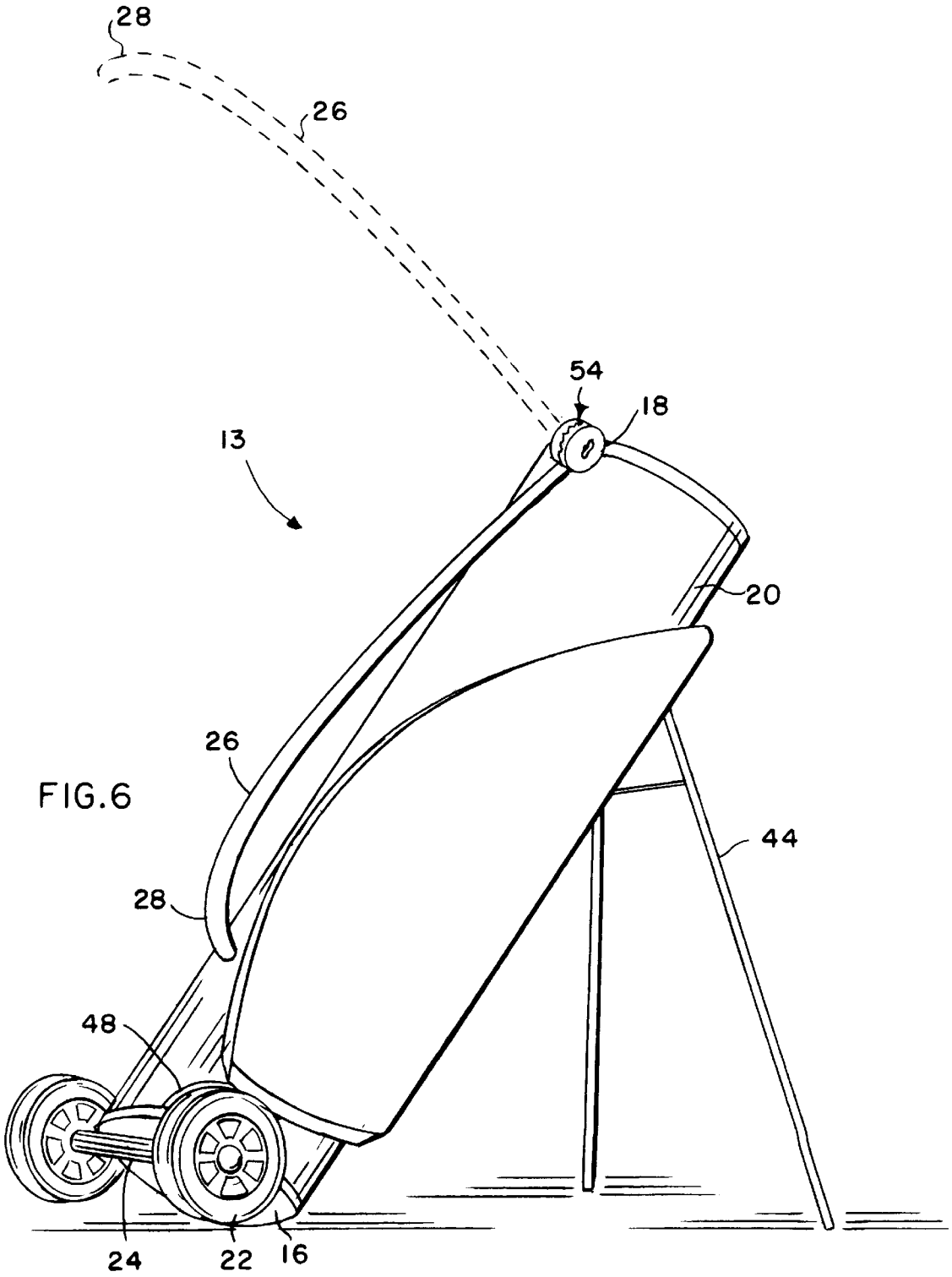
FIG. 6 is perspective view of a third embodiment of the present invention, illustrating a handle which extends from a locking clasp and is pivotable between a folded position and an extended position (shown in phantom)

As shown in the drawings for purposes of illustration, the present invention is concerned with a golf bag pull cart, generally referred to by the reference number 10 in FIGS. 1–3; by the reference number 12 in FIGS. 4 and 5, and by the reference number 13 in FIG. 6. In the following description, functionally equivalent elements of the illustrated embodiments will be referred to by the same reference number.

In accordance with the present invention, the golf bag pull carts 10, 12 and 13 each include a support frame 14 comprised of a base 16 and a spine 18 extending vertically from the base 16. The base 16 and spine 18 may be integrally formed with one another, or attached securely to one another. The support frame 14 may be comprised of any rigid and durable material capable of supporting the weight of a golf bag 20 filled with golf clubs and other golf equipment while rigorously being pulled across a golf course. Yet, the frame 14 of the golf bag pull cart 12 should weigh as little as possible so as not to tire the golfer. Light steel, metal alloys, such as an aluminum alloy, and hardened plastic are preferred.

A pair of wheels 22 are rotatably affixed adjacent the base 16. Typically, the wheels 22 are disposed on opposing ends of an axle 24 which is formed with or otherwise attached to the base 16 of the support frame 14. As illustrated in FIG. 4, the wheels 22 are extendable along the longitudinal axis of the axle 24 away from the base 16. Likewise, the wheels 22 are retractable towards the base 16. Preferably, the wheels 22 lock into a fully extended position and remain in the locked position until the golfer retracts the wheels 22 towards the base 16, where the wheels 22 may lock into a fully retracted position. The locked wheels 22 prevent the golf bag pull cart 10,12 and 13 from becoming unstable due to the unexpected retraction of the wheels 22 while being pulled across the golf course or unexpected extension while in storage. More than one locking position can be provided for differing terrain or the individual golfer's specific needs.

Referring to FIGS. 1–5, the spine 18 is at least partially hollow so as to slidably accept an elongated arm 26 having a handle 28 and a shaft 30 extending downwardly therefrom. The shaft 30 is preferably comprised of two parallel posts 32 which slide into the spine 18. In this preferred form, the handle 28 is U-shaped to conform to the spine 18, while also providing an effective handgrip. The arm 26 is extended when the golfer grasps the handle 28 and pulls the handle 28 away from the spine 18. The arm 22 is retracted into the spine 18 by pushing the handle 28 downwardly until it is fully retracted adjacent the spine 18.

A locking mechanism 34 provides a means for locking the arm 26 in its fully retracted or extended positions. The locking mechanism 34 includes spring biased fingers 36 associated with the shaft 30 and finger receiving recesses 38 associated with the spine 18. The fingers 36 engage the recesses 38 when the arm 26 is in the fully extended or fully retracted positions. The fingers 36 are released from the recesses 38 by pressing a release button 40.

Referring more specifically to FIGS. 1–3, a first embodiment of the golf bag pull cart 10 incorporates the base 16 and spine 18 of the frame 14 into the golf bag 20. The base 16 is formed at a bottom portion of the golf bag 20 and the spine 18 extends up a side of the golf bag 20 to a top edge of the golf bag 20, giving the golf bag 20 a defined shape and support. The golf bag 20 is comprised of any lightweight durable material such as a plastic shell, nylon fabric, polypropylene or any other suitable material. The golf bag 20 is formed like typical golf bags having a generally cylindrical and hollow body so as to accept golf clubs into an open top. The golf bag 20 may include dividers within the hollow body to separate and protect the shafts of the golf clubs and pockets on the exterior of the golf bag 20 to carry other golf equipment such as shoes, tees and golf balls as is necessary.

As illustrated in FIG. 1, the golf bag pull cart 10 may have a grip 42 attached on the golf bag 20 to facilitate moving the golf bag 20 a short distance using only one hand. The golf bag 20 may also incorporate a golf bag stand 44 which is typically pivotally connected to the golf bag 20 so as to extend when placed on the ground and retract back towards the golf bag 20 when the golf bag pull cart 10 is either being rolled or carried. The golf bag 20 may also include shoulder straps 46 attached to the golf bag 20 on generally the opposite side of the stand 44 to facilitate carrying the golf bag pull cart 10 when not being rolled or when the golfer prefers to carry rather than pull the golf bag pull cart 10, such as when crossing terrain not suitable for rolling. Preferably, two straps 46 are crossed over one another to give a more even weight distribution across the golfer's shoulders and back which minimizes soreness and injury.

Referring now to FIGS. 2 and 3, the incorporated base 16 of the golf bag pull cart 10 is preferably formed of a rigid material in order to support the golf bag 20 when resting. Wheel recesses 48 are formed in the base 16, which at least partially accept the retracted wheels 22. The wheels 22 can be extended along a longitudinal axis of the axle 24 away from the base 16, and retracted back towards the base 16 to fit at least partially within the recesses 48 formed in the base 16. The wheel recesses 48 allow the golfer to fully retract the wheels 22 and store the golf bag pull cart 10 without taking additional vehicle trunk or other transportation or storage space.

A second embodiment of the golf bag pull cart 12 is illustrated in FIGS. 4 and 5. The golf bag 20 is exteriorly supported by the generally planar base 16 and the spine 18. Straps 50 are attached to the frame 14 at one end and have fasteners 52 at the other end thereof. The straps 50 surround the golf bag 20 and are tightened using the fasteners 52 to securely hold the golf bag 20 to the support frame 14 of the golf bag pull cart 12.

Figure 7:
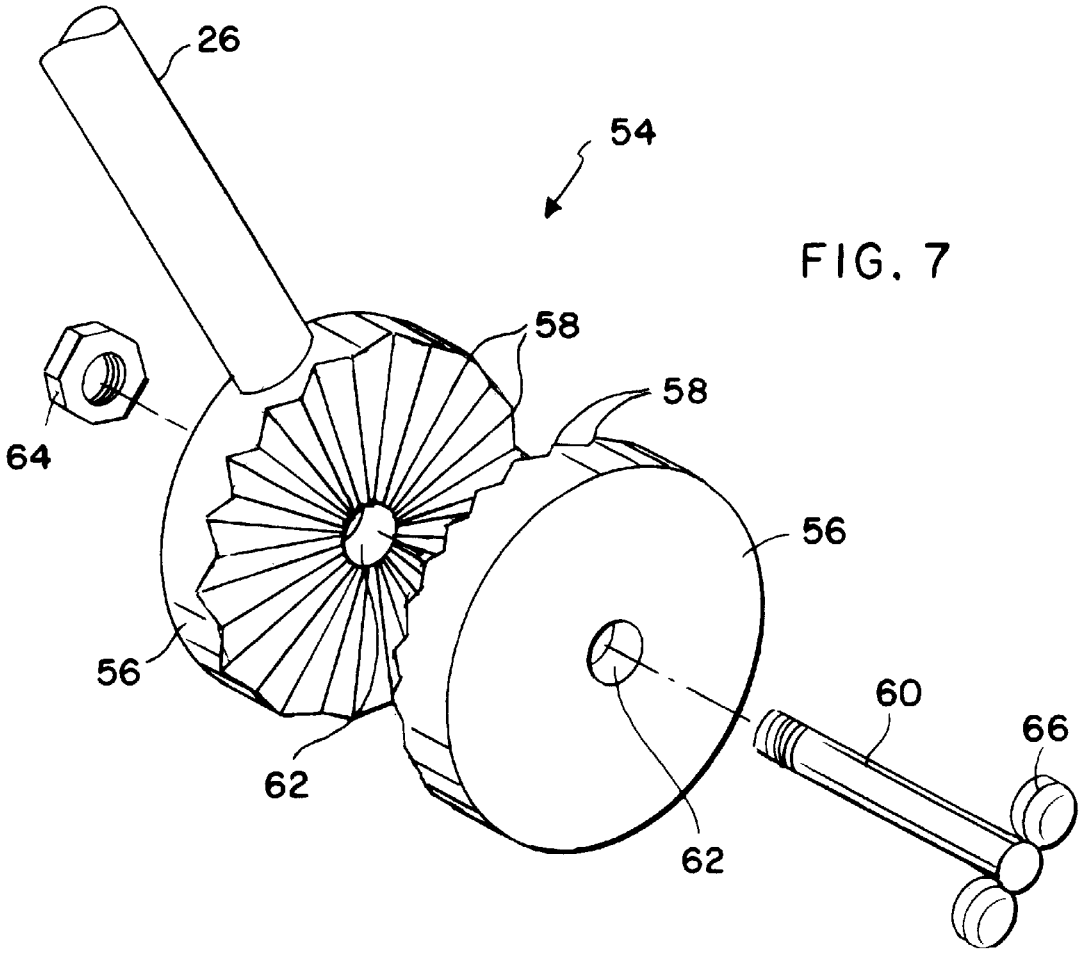
FIG. 7 is an exploded perspective view of the locking clasp of FIG. 6.

A third embodiment of the present invention is illustrated in FIGS. 6 and 7. This embodiment is similar to that illustrated in FIGS. 1–3, but instead of having an arm 26 which slides out of the spine 18, the arm 26 pivots about a locking clasp 54 connected to the spine 18 of the golf bag 20. The arm 26 has a handle 28 at an end thereof which may be retracted towards the golf bag 20 in a folded position for carrying the golf bag pull cart 13. Alternatively, the handle 28 is pivotally extended away from the golf bag 20 for pulling the golf bag pull cart 13. The golf bag pull cart 13 may include one or more shoulder straps 46, a grip 42 and/or a bag stand 44 as need and convenience of the golfer dictate.

As illustrated in FIG. 7, the locking clasp 54 generally comprises two facing discs 56 which each have uniform radial interfitting teeth 58 configured to mate with one another when the locking clasp 54 is in the closed position. The arm 26 extends from one of the discs 56. A tightening screw 60 is inserted through aligned apertures 62 of the discs 56, and a nut 64 is used to securely fasten the discs 56 of the locking clasp 54 together.

After loosening the screw 60 and nut 64, the disc 56 associated with the arm 26 can be rotated as the arm is pivoted. Once the arm 26 is in the desired position, the discs 56 are securely fastened together by re-tightening the screw 60 and nut 64, causing the teeth 58 of each disc 56 to interfit with one another as the discs 56 are brought together. Due to the interfitting of the teeth 58, the discs 56 cannot rotate when the locking clasp 54 is closed, retaining the arm 26 in place. The screw 60 may include wings 66 to facilitate the loosening and tightening of the screw 60.

In use, the golf bag pull carts 10, 12 and 13 may be removed from, for example, the trunk of a vehicle and the handle 28 of the arm 26 grasped and either extended or pivoted upwardly into the fully extended and locked position. If necessary, the handle 28 is manually locked into place. The wheels 22 are then extended and locked into place and the golf bag pull carts 10, 12 and 13 are pulled behind the golfer. Alternatively, the golfer can sling the golf bag pull carts 10, 12 or 13 over his or her shoulder for carrying. The present invention is particularly useful as the golfer has the option of pulling or carrying one piece of equipment which is lightweight, compact and does not require the assembly and disassembly of complicated mechanisms.

Although several embodiments have been described in detail for purposes of illustration, various modifications may be made to each without departing from the scope and spirit of the invention. Accordingly, the invention is not to be limited, except as by the appended claims.

What is claimed is:

1. A golf bag pull cart, comprising:

a support frame of a golf bag having a base incorporated into a bottom of the golf bag, and a spine extending upwardly from the base;

an elongated arm having a handle at one end, the arm being pivotally attached to the spine so as to position the handle adjacent to the spine in a folded carrying position and away from the spine in an extended position;

a support stand pivotally attached to the bag at an upper portion thereof on an opposite side of the bag relative to the handle; and a pair of wheels affixed to the frame adjacent to the base and rotatable about a common axis, the wheels being extendable away from the base and retractable towards the base along the axis, wherein the golf bag has wheel recesses formed at the base into which the wheels are placed in their retracted position.

2. The golf bag pull cart of claim 1, including a locking clasp having a first disc associated with the arm and a second disc connected to the spine, each disc having uniform radial interfitting teeth.

3. The golf bag pull cart of claim 2, including a tightening screw insertable through aligned apertures of the first and second discs, for securely fastening the locking clasp together and preventing relative rotation therebetween.

4. The golf bag pull cart of claim 1, including a shoulder strap connected to the golf bag.

5. A golf bag pull cart, comprising:

a golf bag including an integral frame formed therewith and comprised of a support base at a bottom of the golf bag and a spine extending upwardly from the base;

an elongated arm having a handle at one end, the arm being pivotally attached to the spine so as to position the handle adjacent to the spine in a folded carrying position and away from the spine in an extended position;

a support stand pivotally attached to the bag at an upper portion thereof on an opposite side of the bag relative to the handle; and a pair of wheels affixed to the frame adjacent to the base and rotatable about a common axis, the wheels being extendable away from the base and retractable towards the base along the axis.

6. The golf bag pull cart of claim 5, including a locking clasp having a first disc associated with the arm and a second disc connected to the spine, each disc having uniform radial interfitting teeth.

7. The golf bag pull cart of claim 6, including a tightening screw insertable through aligned apertures of the first and second discs, for securely fastening the locking clasp together and preventing relative rotation therebetween.

8. The golf bag pull cart of claim 5, wherein the golf bag has wheel recesses formed at the base into which the wheels are placed in their retracted position.

9. The golf bag pull cart of claim 5, wherein the golf bag has wheel recesses formed at the base into which the wheels are placed in their retracted position.

10. The golf bag pull cart of claim 9, including a shoulder strap connected to the golf bag.

11. The golf bag pull cart of claim 1, including an axle attached to the base of the frame to which the wheels are rotatably mounted.

12. The golf bag pull cart of claim 5, including an axle attached to the base frame to which the wheels are rotatably mounted.

13. A golf bag pull cart, comprising;

a golf bag having a frame formed integrally therewith and comprised of a support base at a bottom of the golf bag and a spine extending upwardly from the base;

an elongated arm having a handle at one end, the arm being pivotally attached to the spine so as to position the handle adjacent to the spine in a folded carrying position and away from the spine in an extended position;

a locking clasp having a first disc associated with the arm and a second disc connected to the spine, each disc having uniform radial interfitting teeth, and a tightening screw insertable through aligned apertures of the first and second discs for securely fastening the locking clasp together and preventing relative rotation therebetween;

a support stand pivotally attached to the golf bag at an upper portion thereof and on an opposite side of the bag relative to the handle;

an axle attached to the base; and a pair of wheels rotatably mounted to the axle, the wheels being extendable away from the base and retractable, at least in part, into recesses formed at the base.

* * * * *

UNITED STATES PATENT AND TRADEMARK OFFICE

CERTIFICATE OF CORRECTION

PATENT NO. : 6,231,059 B1
DATED : May 15, 2001
INVENTOR(S) : Erwin Cheldin

It is certified that error appears in the above-identified patent and that said Letters Patent is hereby corrected as shown below:

Claim 9,
Should read as follows:
-- 9. The golf bag pull cart of claim 5, including a shoulder strap connected to the golf bag. --

Claim 10,
Should read as follows:
-- 10. The golf bag pull cart of claim 9, wherein the shoulder strap comprises a pair of straps extending from an upper end of the bag to a lower end of the bag. --

Claim 13,
Line 32, after the word comprising, replace -- ; -- with ":".

Signed and Sealed this

Sixteenth Day of April, 2002

*Attest:*

*Attesting Officer*

JAMES E. ROGAN
*Director of the United States Patent and Trademark Office*